United States Patent [19]

Itaya et al.

[11] Patent Number: 4,553,500

[45] Date of Patent: Nov. 19, 1985

[54] APPARATUS AND METHOD FOR DEVELOPING ELECTROSTATIC LATENT IMAGE

[75] Inventors: Masahiko Itaya; Satoshi Haneda; Makoto Tomono, all of Tokyo, Japan

[73] Assignee: Konishiroku Photo Industry Co., Ltd., Tokyo, Japan

[21] Appl. No.: 633,673

[22] Filed: Jul. 24, 1984

Related U.S. Application Data

[63] Continuation of Ser. No. 382,719, May 27, 1982, abandoned.

[30] Foreign Application Priority Data

Jun. 8, 1981 [JP] Japan ..... 56-88569
Jun. 30, 1981 [JP] Japan ..... 56-102543

[51] Int. Cl.[4] ..... G03G 15/09

[52] U.S. Cl. ..... 118/657; 118/680; 355/14 D

[58] Field of Search ..... 118/657, 680; 430/122

[56] References Cited

U.S. PATENT DOCUMENTS 3,914,771 10/1975 Lunde et al. ..... 118/657 X

*Primary Examiner*—John D. Welsh
*Attorney, Agent, or Firm*—James E. Nilles

[57] ABSTRACT

A method of and apparatus for developing an electrostatic latent image wherein an oscillating electric field is formed between a developing member and an electrostatic latent image receptor in synchronism with the rotation of the developing member. A voltage having a waveform obtained by periodically superposing a pulse-like voltage is applied on the developing member.

3 Claims, 10 Drawing Figures

PRIOR ART FIG. 1
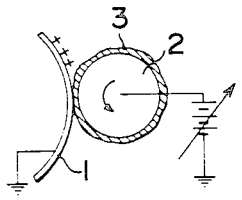
FIG. 2
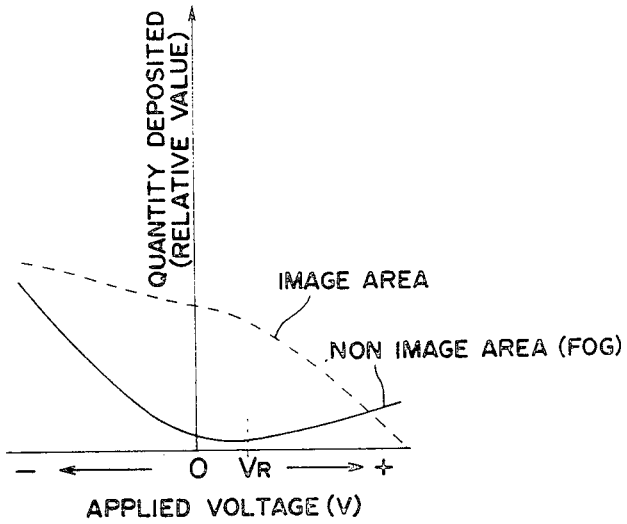
FIG. 3
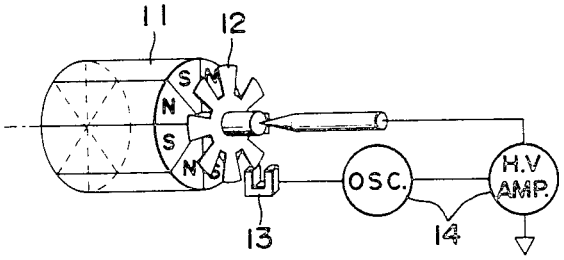

APPARATUS AND METHOD FOR DEVELOPING ELECTROSTATIC LATENT IMAGE

This application is a continuation of application Ser. No. 382,719 filed May 27, 1982, abandoned.

BACKGROUND OF THE INVENTION

1. Field of the Invention

This invention relates to an apparatus and method for developing an electrostatic latent image using a high resistance magnetic developer.

2. Description of the Prior Art

Dry developing methods include a so-called "two-component developing method" using a toner and a carrier and a so-called "one-component developing method" not using the carrier.

Conventional one-component developing methods generally use a magnetic brush developing method. In this method, fogging is likely to occur on the picture image because both positive and negative polarities are dispersed in the magnetic developer due to frictional charging and the developer attaches to non-image areas due to the frictional charge or image force when the developer comes into contact with a picture image receptor.

It has conventionally been attempted to prevent fogging by applying an electric bias to the sleeve of the developing machine, but mere application of a d.c. voltage is not effective, and, on the contrary, increases the fogging at times because of the variance of the amount of charge in the developer itself.

In a developing method which develops the latent image by applying a high a.c. voltage to make the developer flight, fringe-like fogging is likely to occur around the picture image because not only developer having the desired polarity but also developer having an unnecessary polarity are brought into the developing zone. Another problem is that the latitude is very narrow with respect to photosensitive materials having a high residual potential.

Thus, the principal problem with the magnetic brush developing method using a high resistance magnetic developer lies in that fogging is likely to occur. The primary cause of this problem is that the quantity of charge in the developer due to frictional charging is unstable on both polarities. To solve this problem, a charge injection method or the like has been proposed but it has been very difficult to control the amount of charge.

As a method of applying electric bias, it has been a customary practice to apply a voltage close to the potential of non-image areas of the picture image receptor on the developing device, but since the latitude is narrow in the high resistance magnetic developer, applying a bias invites fogging or lowers the picture image density.

FIG. 1 illustrates the state in which a toner layer 3 on a developing sleeve 2 is in contact with a picture image receptor 1. When a d.c. voltage is applied to the developing sleeve 2, the developer attaches to the picture image receptor 1 in the amounts illustrated in FIG. 2. In this drawing, $V_R$ represents the voltage of non-image areas, with the potential of the electrostatic latent image areas being positive. When the applied voltage is changed in both the positive and negative directions, the quantity deposited shows a minimum near $V_R$ in the non-image area but fogging occurs on the positive side with respect to $V_R$ as positive toner attaches, and on the negative side with respect to $V_R$ as negative toner similarly attaches. This phenomenon always occurs with the one-component magnetic developer.

The simplest method of eliminating fogging is to prevent the developer layer from coming into contact with the picture image receptor. In this case, however, the voltage at the image area must be increased and the toner layer on the developing sleeve must be made uniform in order to increase the picture image density and to obtain a uniform picture image. Also, the toner layer must be thin. However, the resulting picture image is not clear.

SUMMARY OF THE INVENTION

Considering the problem from a novel point of view, the present invention contemplates to obtain a stable picture image free of fogging by electrically selecting a developer having a desired charge quantities in the developing zone on the premise that developer does have dispersed charge quantities, and to provide an apparatus which accomplishes this object.

In the present invention, the developer and the picture image receptor are prevented from adhering to each other due to the frictional charge while the positions of the developer layer on the sleeve of the developing device and the picture image receptor are kept in such a relation as not to come into contact with each other, a high voltage of the opposite polarity to the potential of the latent image is superposed with a voltage close to the potential of the non-image areas in this state and applied in pulses to a developer receptor or to a rotary magnetic roller, with the pulses applied in synchronism with the rotary magnet and the developer selectively brought into the developing zone.

The present invention is directed to provide a developing apparatus and method giving a picture image having sufficient picture image density and clearness for an ordinary potential of a picture image area by using a d.c. bias and a pulse-like voltage superposed with the d.c. bias in the state in which the toner layer does not come into contact with the picture image receptor. This first object of the invention can be accomplished by an apparatus for developing an electrostatic latent image including a developing bias application device, said device comprising (1) a rotary member rotating integrally or in synchronism with a rotary magnet disposed inside the apparatus; (2) synchronizing signal generation means for taking out a synchronizing signal from the rotary member; and (3) bias means controlled by the synchronizing signal from the synchronizing signal generation means and forming an oscillating electric field between the developing means and the electrostatic latent image receptor.

In a method of developing an electrostatic latent image using a one-component magnetic developer, the other object of the invention can be accomplished by a developing method characterized in that the magnetic developer is brought into the developing zone using a rotary magnetic roller having a non-magnetic cylindrical sleeve and a magnetic roller disposed inside the sleeve, and a voltage having a waveform obtained by periodically superposing a pulse-like voltage generating a sufficient electric field to cause the developer to flight from the rotary magnetic roller towards the electrostatic latent image on an electrostatic latent image receptor with the voltage of the same polarity as that of the electrostatic latent image at such a level as to prevent the flight of toner having the same polarity as that of the electrostatic latent image from the rotary magnetic roller towards a non-image area, and applied to the rotary magnetic roller inside the developing zone.

These and other objects and features of the invention will become more apparent from the following description when taken in conjunction with the accompanying drawings.

BRIEF DESCRIPTION OF THE DRAWINGS

FIG. 1 shows a conventional developing device;

FIG. 2 shows the relation between the applied voltage and the quantity of toner deposited when the developing device of FIG. 1 is used;

FIG. 3 shows the developing bias application device in the present invention;

DESCRIPTION OF THE PREFERRED EMBODIMENTS

Figure 4:
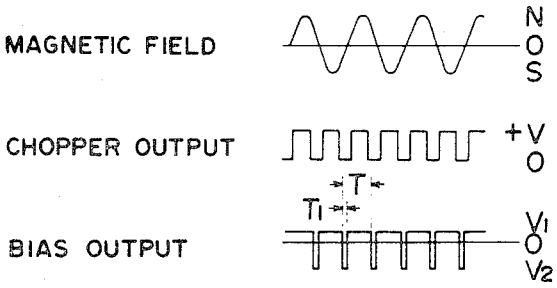
FIG. 4 shows the relation between the alternation of a magnetic field and a high voltage output for bias when the developing bias application device of FIG. 3 is used.

In FIG. 3, reference numeral 11 represents a magnetic roller and reference numeral 12 represents a rotary member which rotates either integrally or in synchronism with the magnetic roller 11. Reference numeral 13 represents a synchronizing signal generation means for taking out a synchronizing signal from the rotary member 12. Reference numeral 14 represents bias means controlled by the synchronizing signal from the synchronizing signal generation means 13 and generating an oscillating electric field between developing means and an electrostatic latent image receptor. The bias means 14 may, for example, take the form of a known commercially available high voltage operational amplifier such as a Model 606 device manufactured by the TREK company.

The synchronizing signal generation means 13 may use an optical method such as shown in the drawing or a magnetic method using Hall elements. In an optical method the element 12, which for example may take the form of plate made of metal (i.e., aluminim, iron), nonmetal (i.e., resin, paper) or other suitable material, periodically interrupts a light beam in element 13 which includes a photo-coupler to produce a pulse. When the timing is matched with the alternation of the magnetic field, a bias output is generated by electrically processing the bias means 14. FIG. 4 illustrates the waveforms of chopper output and high voltage output for bias in synchronism with the alternation of magnetic field, and the alternation of the magnetic field is in synchronism with the high voltage output for bias.

Figure 5:
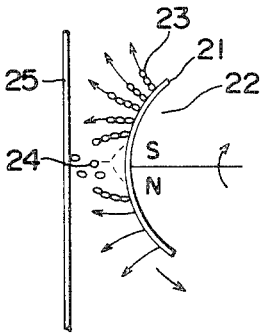
FIG. 5 shows schematically the operating condition of the developer in accordance with the present invention.

This bias voltage will now be explained. Now, it is assumed that the electrostatic latent image has a positive polarity, $V_1$ is set to a voltage close to the potential of the non-image area, and $V_2$ is a voltage necessary for obtaining a necessary picture image density. As shown in FIG. 5, the developer behaves such that it is transferred into the developing zone 24 as the developing sleeve 21 and the magnetic roller 2 rotate. While a cluster of developer 23 lies at the N-S boundary of the magnetic roller 22, a pulse voltage $V_2$ having a polarity opposite that of the potential at the image area of a photosensitive member 25 is applied in synchronism with the electric bias. Hence, developer having a polarity opposite to that of the latent image flights towards the latent image.

To make the developer flight while the cluster of developer is lying, the magnetic field in the direction perpendicular to the latent image surface is weak in the proximity of the latent image and the developer flights like cloud, thereby effecting development. At the portions where the clusters are rising, the voltage $V_1$ in the direction which attracts the projecting developers is applied in synchronism with the developing sleeve 21 so that developer dust and the developer which are attached to non-image areas and cause fogging are removed.

In the developing process described above, fogging can be prevented and the picture image density can be changed by adjusting the pulse width, the pulse voltage and the base voltage by the bias application device while keeping the alternation of the magnetic field in synchronism with the high voltage output for bias.

When a 10-pole magnetic roller is used with the sleeve rotation of 50 r.p.m. and magnetic roller rotation of 1,200 r.p.m., the alternation of magnetic field is 200 times/sec. Good results can be obtained in this case by keeping the pulse width $T_1$ below 20% of the period.

When the potential at the image area is +600 V, good results can also be obtained if the pulse potential is about −400 V at the peak. Switching with a quick rise can not generally be expected at a high voltage and the pulse becomes like an impulse. In this case, substantially the same effects can be obtained by adjusting the pulse width to a suitable value.

As the developing device, an ordinary rotating magnetic roller type may be employed but the picture image becomes more stable if the sleeve also rotates.

If the developing process is carried out using the abovementioned developing device in combination with the bias application device, a high resistance magnetic developer can now be used. Furthermore, the magnetic material content of the developer can be reduced, and transfer to plain paper also becomes possible because only the developer having a predetermind polarity attaches to the latent image. Moisture resistance as well as fixation properties can also be improved. Fogging can be restricted for a photosensitive material having a high residual potential by properly selecting $V_1$. Since development is effected at a portion where the influence of magnetic force of the magnetic roller is less, the magnetic force of magnetic roller can be increased to prevent scattering of the developer.

Figure 6:
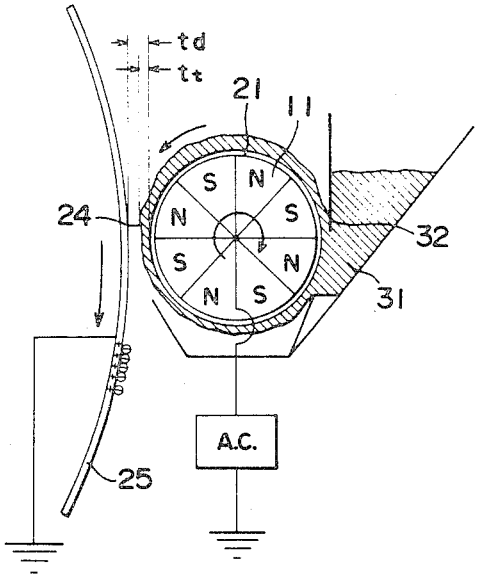
FIGS. 6 and 7 show an apparatus in accordance with an embodiment of the present invention.
Figure 7:
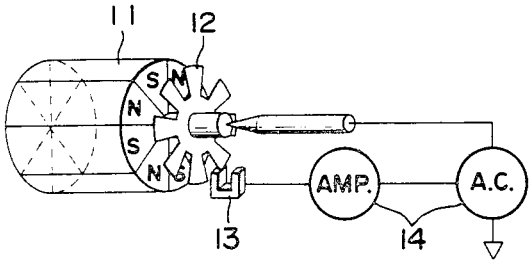
Figure 8:
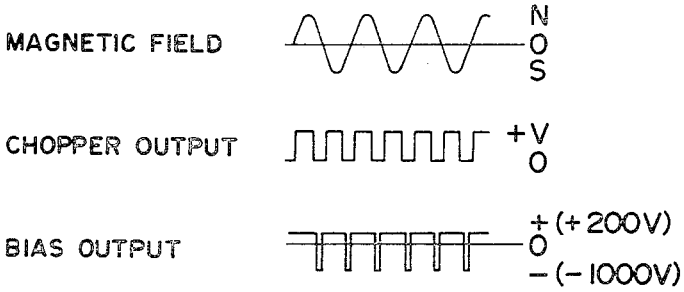
FIG. 8 shows the relation between the alternation of a magnetic field and a high voltage output for bias when the apparatus of FIGS. 6 and 7 is used.

Next, a first embodiment of the present invention will be described. FIGS. 6 and 7 illustrate the developing device and voltage application device according to the present invention. After the one-component magnetic developer inside a toner feed section 31 is restricted by a cluster restriction section 32, it is transferred by rotating magnetic roller 11 and developing sleeve 21 into the developing zone 24, where developing is effected. The pulse is applied to the developing sleeve 21 by the chopper 13 when the boundary of the N-S poles of the magnetic roller 11 is positioned to a relative developing zone 24 of a picture image receptor 25. FIG. 8 illustrates the relation between the alternation of magnetic field and the pulse.

Here, the developer has the following composition:

Styrene-acrylic resin: 60 wt% magnetite 37 wt %:

charge control agent: 1 wt % carbon black 2 wt % A Se photosensitive material is used for the picture image receptor 25 and the potentials of the electrostatic latent image are as follows:

maximum potential at image areas = +600 V potential at non-image areas = +100 V

The developing conditions are listed below:

applied voltages $V_1$=200 V, $V_2$=−400 V linear velocity of picture image receptor=180 mm/sec diameter of developing sleeve=31.4 mm rotational speed of developing sleeve=50 r.p.m. (CCW)

rotational speed of magnetic roller=1,200 r.p.m. (CCW)

magnetic field on the surface of sleeve=800 Gauss number of poles of magnetic roller=10 (poles)

thickness of toner layer ($t_t$)=0.2 mm distance between picture image receptor and developing sleeve ($t_d$)=0.4 mm Under the developing conditions listed above, a picture image having a maximal reflection density of 1.2, high sharpness, and free of fog can be obtained at 20° C. and 50% RH.

In a second embodiment of the present invention, a bipolar one-component toner having the following composition, as disclosed in Japanese Patent Publication Laid-Open to Public Inspection No. 106,734/1977, is used:

copolymer of styrene (95 mol%) and dimethyl acrylate (5 mol%) as the resin . . . 40 parts, "Mabublack BL-100" ferromagnetic powder . . . 60 parts.

The toner is formulated such that the magnetite content of the toner is high and magnetite is exposed on the toner surface layer. In this case, too, a satisfactory picture image can be obtained by using the devices and applied pulse described in the first embodiment.

In using the bipolar toner, good development can be effected for both a positively charged latent image and a negatively charged latent image by inverting the polarities of $V_1$ and $V_2$ of the high voltage output for bias shown in FIG. 8 while synchronizing the alternation of the magnetic field with the high voltage output for bias.

Figure 9:
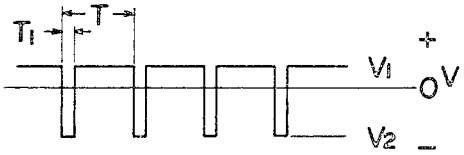
FIGS. 9 and 10 show waveforms of applied bias voltages.
Figure 10:
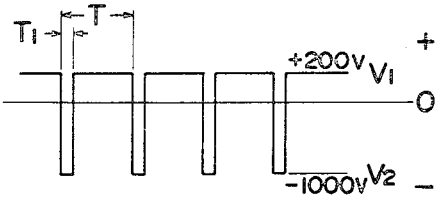

FIGS. 9 and 10 show the waveform of the applied voltage with a positively charge electrostatic latent image in the method of the present invention. The voltage $V_1$ is set to a level higher than the potential at the non-image area while the voltage $V_2$ is set to a level required to obtain a necessary picture image density. Good results can be obtained when the pulse width $T_1$ is set to a level below 30% of its period T. The period T of the impressed voltage is preferably from 0.5 msec to 5 msec.

The behavior of the developer will now be explained. When the gap between the developing sleeve and the electrostatic latent image receptor is made greater than the toner layer on the developing sleeve, the negative developer is projected into the space from the developing sleeve towards the electrostatic latent image receptor when the voltage $V_2$ is applied. If an electrostatic latent image having a sufficiently high potential exists on the electrostatic latent image receptor, the developer thus projected is accelerated towards the latent image and attaches to and builds up on the latent image portion. On the other hand, the developer stays in dust form in the proximity of the non-image area.

At a time $T_1$ after application of the voltage $V_2$, the developer reaching the voltage $V_1$ and staying in the non-image area is attracted back to the developing sleeve so that the non-image area is not developed. This voltage $V_1$ is preferably within the range of ±150 V with respect to the voltage of the non-image area. If the voltage $V_1$ is a high voltage exceeding this range, the developer having the opposite polarity would attach to the electrostatic latent image receptor. If the voltage is below this range, on the other hand, the effects of the invention are not exhibited.

It is necessary to determine the period T of the applied voltage lest step-like non-uniformity occur in the transverse direction due to the linear velocity of the electrostatic latent image receptor. The pulse width $T_1$ of the applied voltage is to be determined in accordance with the charge quantity and mass of the toner, and the period T and the pulse width $T_1$ are to be determined experimentally. The developing device may be of an ordinary sleeve rotation type or of a magnet rotation type or a combination of them.

Since the present invention uses the method which is based on the principle described above, a high resistance magnetic developer can be employed, and the magnetic material content of the developer can be reduced. Because only developer having one polarity attaches to the latent image, transfer to plain paper is possible and both moisture resistance and fixation properties can be improved. Fogging can also be restricted for a photosensitive material having a high residual potential by selecting a suitable voltage $V_1$. Since one of the characterizing features of the present invention is that contact of the developer with the electrostatic latent image receptor is weak, the present invention provides good results over an extended period even for photosensitive materials with a low surface strength such as organic photosensitive materials.

Incidentally, the method of the present invention can be effectively applied to a 2-roller system developing method such as disclosed in Japanese Patent Publication Laid-Open to Public Inspection No. 14,260/1981, for example.

In such a case, a developer layer having a uniform charge polarity and a uniform charge quantity can be formed on the developing rollers by making the thickness of the developer layer on the developer feed roller smaller than the thickness of the developer layer on the developing roller, and an excellent picture image can be obtained.

The thickness of the developer layer on the developer feed roller can be reduced by properly adjusting the voltage applied between the developing roller and the developer feed roller, the relative speed between these rollers, and the like.

What is claimed is:

1. In an apparatus for developing an electrostatic latent image on an electrostatic latent image receptor using a onecomponent dielectric magnetic toner wherein said electrostatic latent image receptor and a developing sleeve retaining thereon said toner are arranged such that the toner does not contact with said latent image receptor when a developing electric field is not applied, and a magnetic roller formed thereon with magnet poles of different polarity alternately is arranged in said developing sleeve rotatably, the improvement characterized by comprising a bias application device having a rotary member rotatable in synchronism with said rotatable magnetic roller, synchronizing signal generation means for taking out a synchronizing signal from said rotary member, and bias means controlled by said synchronizing signal from said synchronizing signal generation means and forming an oscillating electric field between said developing means and said electrostatic latent image receptor, wherein said oscillating electric field is so formed that when the boundary portion of the magnet poles of the magnetic roller is faced to said electrostatic latent image receptor said toner flies from said developing sleeve toward said electrostatic latent image receptor and near the boundary portion said flight toner is attracted toward said developing sleeve.

2. In a method of developing an electrostatic latent image on an electrostatic latent image receptor using a one-component dielectric magnetic toner, wherein said electrostatic image receptor and a developing member are arranged such that said toner does not contact with said latent image receptor, the improvement characterized by comprising the steps of bringing said magnetic toner into a developing zone using said developing member having a non-magnetic cylindrical sleeve and rotatable magnetic means including magnets of different polarity arranged mutually inside said sleeve, and applying between said developing member and said image receptor an oscillating electric field having a predetermined period, within a predetermined time in said period said electric field being sufficient to cause flight of said magnetic toner toward said electrostatic latent image from said developing member and within the remaining time in said period said electric field being such a level as to prevent flight of a toner of the same polarity as that of said electrostatic latent image toward a non-image area from said developing member.

3. A method according to claim 2, wherein the timing of said predetermined time to cause flight of said magnetic toner is in synchronism with the rotation period of said magnetic roller within said developing member, and in synchronism with the timing at which the boundary portion of the adjacent magnet poles of said magnetic roller is positioned to face said latent image receptor.

* * * * *